United States Patent [19]

Takegawa

[11] Patent Number: 4,716,941

[45] Date of Patent: Jan. 5, 1988

[54] FAULTY PICKING DIAGNOSING SYSTEM FOR A FLUID JET LOOM

[75] Inventor: Yujiro Takegawa, Ishikawa, Japan

[73] Assignee: Tsudakoma Corp., Ishikawa, Japan

[21] Appl. No.: 939,211

[22] Filed: Dec. 8, 1986

[30] Foreign Application Priority Data

Jan. 13, 1986 [JP] Japan ..... 61-5850

[51] Int. Cl.[4] ..... D03D 51/18

[52] U.S. Cl. ..... 139/336; 139/370.2; 139/435; 250/561

[58] Field of Search ..... 139/1 R, 336, 370.2, 139/435, 452; 250/559, 561, 562, 571

[56] References Cited

U.S. PATENT DOCUMENTS 4,476,901 10/1984 Sainen ..... 139/370.2
4,546,263 10/1985 Gotoh et al. ..... 139/370.2
4,595,039 6/1986 Tholander ..... 139/452
4,607,668 8/1986 Tholander ..... 139/452
4,617,971 10/1986 Hellstroem ..... 139/370.2
4,625,770 12/1986 Ishikawa ..... 139/370.2
4,658,865 4/1987 Gotoh ..... 139/435

FOREIGN PATENT DOCUMENTS 60-110952 6/1985 Japan .

*Primary Examiner*—Henry S. Jaudon
*Attorney, Agent, or Firm*—Flynn, Thiel, Boutell & Tanis

[57] ABSTRACT

A faulty picking diagnosing system for a fluid jet loom equipped with a fluid jet picking device. The faulty picking diagnosing system is capable of diagnosing a faulty picking cycle while the loom is in operation, to specify the causative parts of the faulty picking cycle among the functional parts of the loom, through the detection of acutal weft yarn unwinding times when coils of the weft yarn stored on the measuring and storing drum of the loom are unwound, respectively, and actual weft yarn arrival times when the free end of the picked weft yarn arrives at predetermined detecting positions, respectively, and comparing the detected data with the corresponding target values.

5 Claims, 7 Drawing Figures

FAULTY PICKING DIAGNOSING SYSTEM FOR A FLUID JET LOOM

BACKGROUND OF THE INVENTION

1. Field of the Invention:

The present invention relates to a fluid jet loom equipped with a picking device including a main picking nozzle and a plurality of groups of auxiliary nozzles and, more specifically, to a faulty picking diagnosing system capable of diagnosing a faulty picking operation through the measurement of the actual weft yarn unwinding time, the actual weft yarn arrival time and, when necessary, the flow rate of the picking fluid, and comparison of the measured results with the corresponding target values.

2. Prior Art:

The fluid jet loom uses a jet of air or water for picking a weft yarn. Faulty picking results from inappropriate jet stating time, inappropriate jet ending time and/or inappropriate pressure of the picking fluid or from unsynchronized weft yarn unwinding and picking fluid jetting.

Japanese Patent Laid-open Publication No. 60-110,952 discloses an invention which measures the weft yarn arrival time at a position in the path of the weft yarn, compares the measured weft yarn arrival time with a target weft yarn arrival time, and regulates the pressure of the picking fluid on the basis of the result of the comparison so that correct picking operation is achieved. However, since the faulty picking operation is not diagnosed, it is possible that the faulty picking operation occures again after the correction of the pressure of the picking fluid.

Generally, it has been a conventional practice to determine the cause of faulty picking operation through the visual inspection of picking condition by the operator, in which the causes of faulty picking operation are classified roughly into short pick, yarn end breakage, faulty shedding, bent pick, and weft breakage. Accordingly, it has been fifficult to find the exact cause of faulty picking operation through the visual inspection of the picking condition by the operator. This difficulty has been a significant obstacle to the stable operation of the loom. It is essential, particularly in a weaving mill equipped with many looms, to the enhancement of productivity and the improvement of the quality of fabrics to find the exact cause of faulty picking operation quickly and to correct the cause rapidly.

SUMMARY OF THE INVENTION

Accordingly, it is an object of the present invention to provide a faulty picking diagnosing system capable of correctly specifying the exact cause of faulty picking operation through the measurement of the actual weft yarn unwinding time, the actual weft yarn arrival time and, if necessary, other picking conditions, and the comparison of the measured data with the corresponding target values during the weaving operation of the loom.

According to the present invention, the actual weft yarn arrival time and the actual weft yarn unwinding time are measured individually, the measured results are compared with the corresponding target times, and then the causative parts and factors of the faulty picking operation in the picking elements, namely, the measuring and storing drum, the weft yarn restraining pin, the main picking nozzle, the auxiliary nozzles and the reed, are specified during the weaving operation of the loom. The comparison of the measured data and the corresponding target values includes the comparison of the actual weft yarn unwinding time and a target weft yarn unwinding time at the moment of start of the picking operation, the comparison of the actual weft yarn arrival time when the weft yarn arrives at the intermediate position in the pass of the weft yarn and a target weft yarn arrival time for the intermediate position, and the comparison of the actual weft yarn arrival time when the weft yarn arrives at the final position and a target weft yarn arrival time for the final position. The condition of the picking operation is evaluated on the basis of the results of the comparison and, when the condition of the picking operation is abnormal, the picking operation is diagnosed automatically to specify the cause of the faulty picking operation. Thus, the causes of the faulty picking operation, such as bent pick, tip trouble, faulty reed, inappropriate jetting operation of the auxiliary nozzles, incorrect disposition of the auxiliary nozzles and dirty reed, other than apparent causes, such as accidental restraint on the weft yarn on the measuring and storing drum, abnormal pressure of the picking fluid supplied to the main picking nozzle and simple faulty shedding, are specified. Consequently, appropriate action for eliminating the causes of the faulty picking operation is possible.

The above and other objects, features and advantages of the present invention will become more apparent from the following description taken in conjunction with the accompanying drawings.

DESCRIPTION OF THE PREFERRED EMBODIMENT

Figure 1:
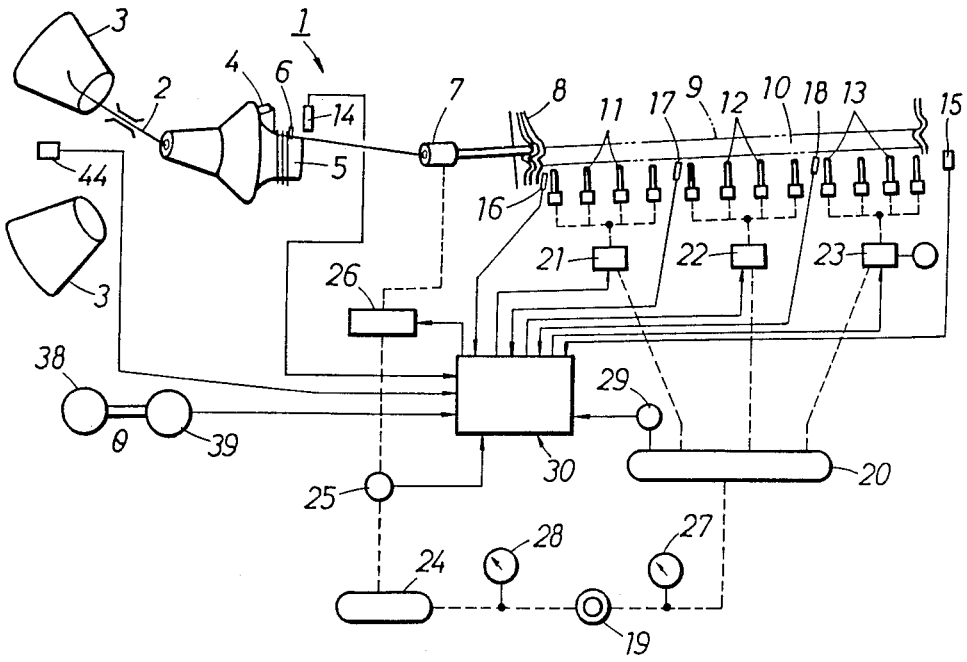
FIG. 1 is a block diagram of a faulty picking diagnosing system, in a preferred embodiment, according to the present invention.

In FIG. 1, indicated at 1 is a faulty picking diagnosing system according to the present invention illustrated in association with the mechanical components of a picking device.

A weft yarn 2 drawn out from one of yarn packages 3 is passed through a rotary yarn guide 4 and is wound around a stationary measuring and storing drum 5 by the rotary motion of the rotary yarn guide 4. While the weft yarn 2 is being wound around the drum 5, a restraining pin 6, one of the picking control elements, is advanced toward the circumference of the drum 5 to retain the weft yarn 2 on the drum 5. In picking the weft yarn 2 stored on the drum 5 into the shed, the restraining pin 6 is retracted from the circumference of the drum 5, and then a main picking nozzle 7, another picking control element, jets a picking fluid to pick the weft yarn 2 along a path 10 defined by the guide 9 of a reed 8.

On the other hand, while the weft yarn 2 is traveling along the path 10, three groups, by way of example, of auxiliary nozzles 11, 12 and 13 urge the weft yarn 2 sequentially in the picking direction. The completion of the picking operation is detected photoelectrically by a final position weft yarn arrival detector 15 disposed on the extension of the path 10. The unwinding time of each one of the coils of the weft yarn 2 wound on the drum 5 is detected photoelectrically by an unwinding detector 14 disposed on the picking side every unwinding cycle. The unwinding detector 14 is disposed adjacent to the restraining pin 6. The weft yarn arrival times at the respective first auxiliary nozzles of the groups of the auxiliary nozzles 11, 12 and 13 are detected by weft yarn arrival detectors 16, 17 and 18, respectively.

The respective groups of the auxiliary nozzles 11, 12 and 13 are connected through shutoff valves 21, 22 and 23, respectively, and a common subtank 20 to a fluid source 19. The auxiliary nozzles, similarly to the main picking nozzle 7, are the picking control elements. The main picking nozzle 7 is connected through a main shutoff valve 26, a pressure sensor 25 and a main tank 24 to the fluid source 19. Pressure regulators 27 and 28 are connected to the outlet of the fluid source 19. The internal pressure of the subtank 20 is detected by a pressure sensor 29.

Figure 2:
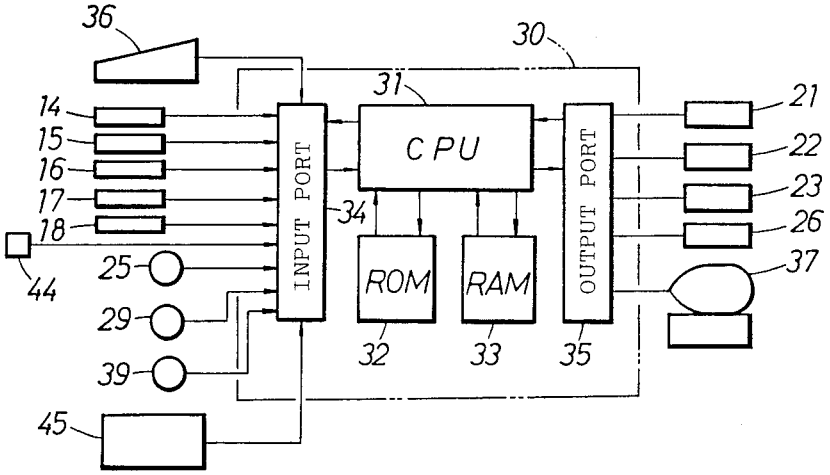
FIG. 2 is a block diagram showing the constitution of the essential part of the faulty picking diagnosing system of FIG. 1.

The faulty picking diagnosing system 1 of the present invention is provided with an arithmetic and logic unit 30. As illustrated in FIG. 2, the arithmetic and logic unit 30 comprises, by way of example, a CPU 31, a ROM 32 and a RAM 33. The unwinding detector 14, the final position weft yarn arrival detector 15, the weft yarn arrival detectors 16, 17 and 18, the pressure sensors 25 and 29, a yarn change detector 44, a reference signal generator 39, a counter circut 45 and an input setting unit 36 are connected to the input port of the arithmetic and logic unit 30. The shutoff valves 21, 22 and 23, the main shutoff valve 26 and a display unit 37 are connected to the output port of the arithmetic and logic unit 30.

The CPU 31 detects the crankshaft angle of the crankshaft 38 of the loom by means of the reference signal generator 39 and executes a necessary control program to carry out a predetermined control operation in synchronism with the weaving motion of the loom.

Figure 3:
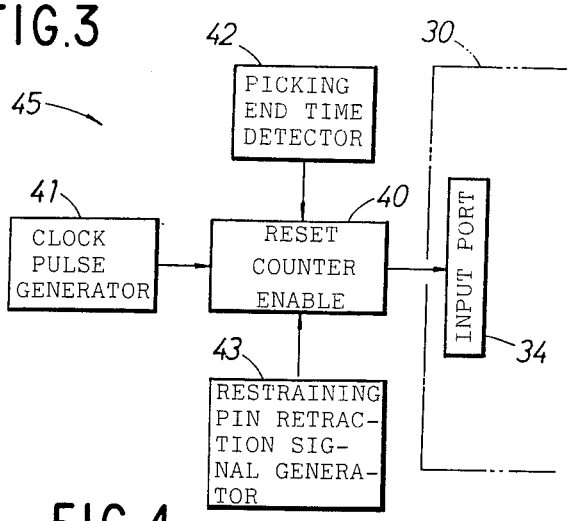
FIG. 3 is a block diagram of the time measuring unit of the faulty picking diagnosing system of FIG. 1.

As illustrated in FIG. 3, the counter circuit 45 has a counter 40 for measuring time. The counter 40 has an input connected to a clock pulse generator 41, a reset input connected to a picking end time detector 42, an enable input connected to a restraining pin retraction signal generator, and an output connected through the input port 34 to the CPU 31.

As mentioned above, the main picking-nozzle 7 picks the weft yarn 2 into the path 10 after the weft yarn 2 wound on the drum is released free by retracting the restraining pin 6. Complete picking operation is detected by the final position weft yarn arrival detector 15 disposed at a position on the weft yarn arrival side of the loom. The picking device completes one picking cycle in one weaving cycle of the loom, and the arrival of the weft yarn 2 at the final arrival position is detected at a fixed crankshaft angle.

During the picking operatio, the unwinding detector 14 detects an actual unwinding time every unwinding of the coils of the weft yarn on the drum 5. The weft yarn arrival detectors 16, 17 and 18 detect the arrival of the free end of the picked weft yarn 2 at the corresponding positions in the path 10. The final position weft yarn arrival detector 15 detects, as mentioned above, the arrival of the free end of the picked weft yarn 2 at the final arrival position.

Figure 4:
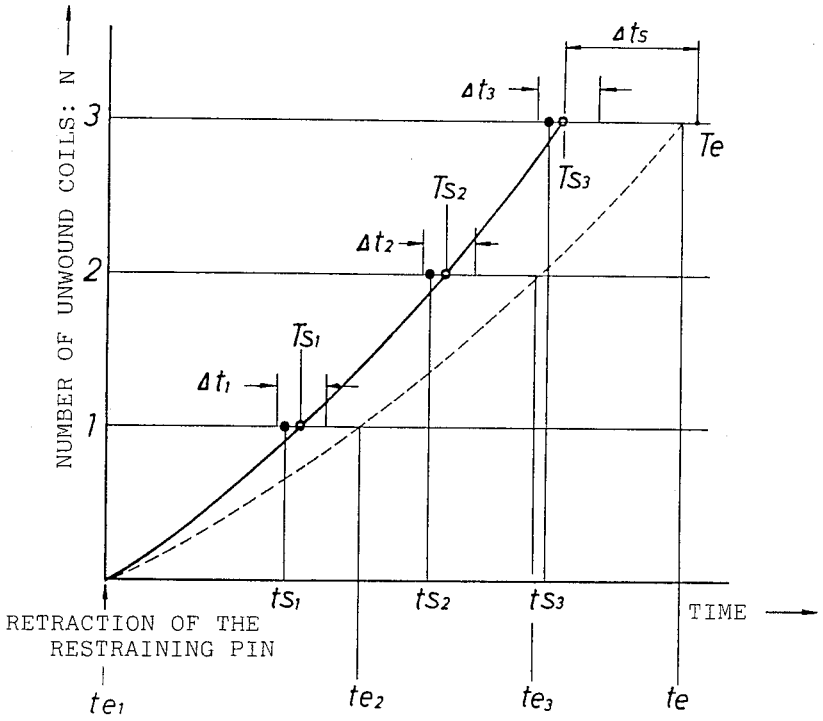
FIG. 4 is a graph showing the variation of the number of unwound coils of the weft yarn, namely, the distance of travel of the weft yarn, with time.

Referring to FIG. 4, actual unwinding times $t_{s1}$, $t_{s2}$ and $t_{s3}$ and actual weft yarn arrival times $t_{e1}$, $t_{e2}$ and $t_{e3}$ are measured on a time axis, while the number N of unwound coils of the weft yarn 2 is measured on a vertical axis. The origin of the graph corresponds substantially to a restraining pin retraction time. The time axis is also an axis on which the crankshaft angle $\theta$ of the crankshaft 38 is measured.

At a time when one coil of the weft yarn 2 is unwound from the drum 5 after the retraction of the restraining pin 6 has been started, the unwinding detector 14 provides an actual unwind time signal $t_{s1}$. Similarly, the unwinding detector 14 provides actual unwind times $t_{s2}$ and $t_{s3}$ sequentially when the second and third coils of the wefrt yarn 2 are unwound. The number of coils of the weft yarn 2 necessary for one picking cycle is supposed to be three in this descrition. Accordingly, at the moment when the third coil of the weft yarn 2 is unwound, the weft yarn 2 is to be extended across the entire length of the path 10 for complete picking.

While the picked weft yarn 2 is traveling along the path 10, the weft yarn arrival detectors 16, 17 and 18 and the final position weft yarn arrival detector 15 detect the free end of the picked weft yarn 2 and provide actual weft yarn arrival time signals representing the actual weft yarn arrival times $t_{e1}$, $t_{e2}$, $t_{e3}$ and $t_e$, respectively. The actual picking characteristic, namely, the actual variation of the distance of travel of the picked weft yarn with time, is indicated by a curve resembling a quadratic curve as shown in FIG. 4. In FIG. 4, target unwind times $T_{s1}$, $T_{s2}$ and $T_{s3}$ for the first, second and third coilss of the weft yarn are marked with circles, respectively, while the actual unwind times $t_{s1}$, $t_{s2}$ and $t_{s3}$ are marked with solid circles. The time difference $\Delta t_s$ between the target unwind time $T_{s3}$ for the last col (the third coil) of the weft yarn-and the target final position weft yarn arrival time $T_e$. This time difference $\Delta t_s$ is estimated beforehand through a trial weaving operation, and is substantially a fixed value when the picking operation is normal. In FIG. 4, indicated at $\Delta t_1$, $\Delta t_2$ and $\Delta t_3$ are allowable time ranges of the actual weft yarn arrival times about the corresponding target weft yarn arrival times $T_{s1}$, $T_{s2}$ and $T_{s3}$, respectively. The allowable time ranges are determined before starting the weaving operatin, however, the values of the allowable time ranges may be corrected as the weaving operation progresses, through the learning function of the arithmetic and logic unit 30.

Figure 5:
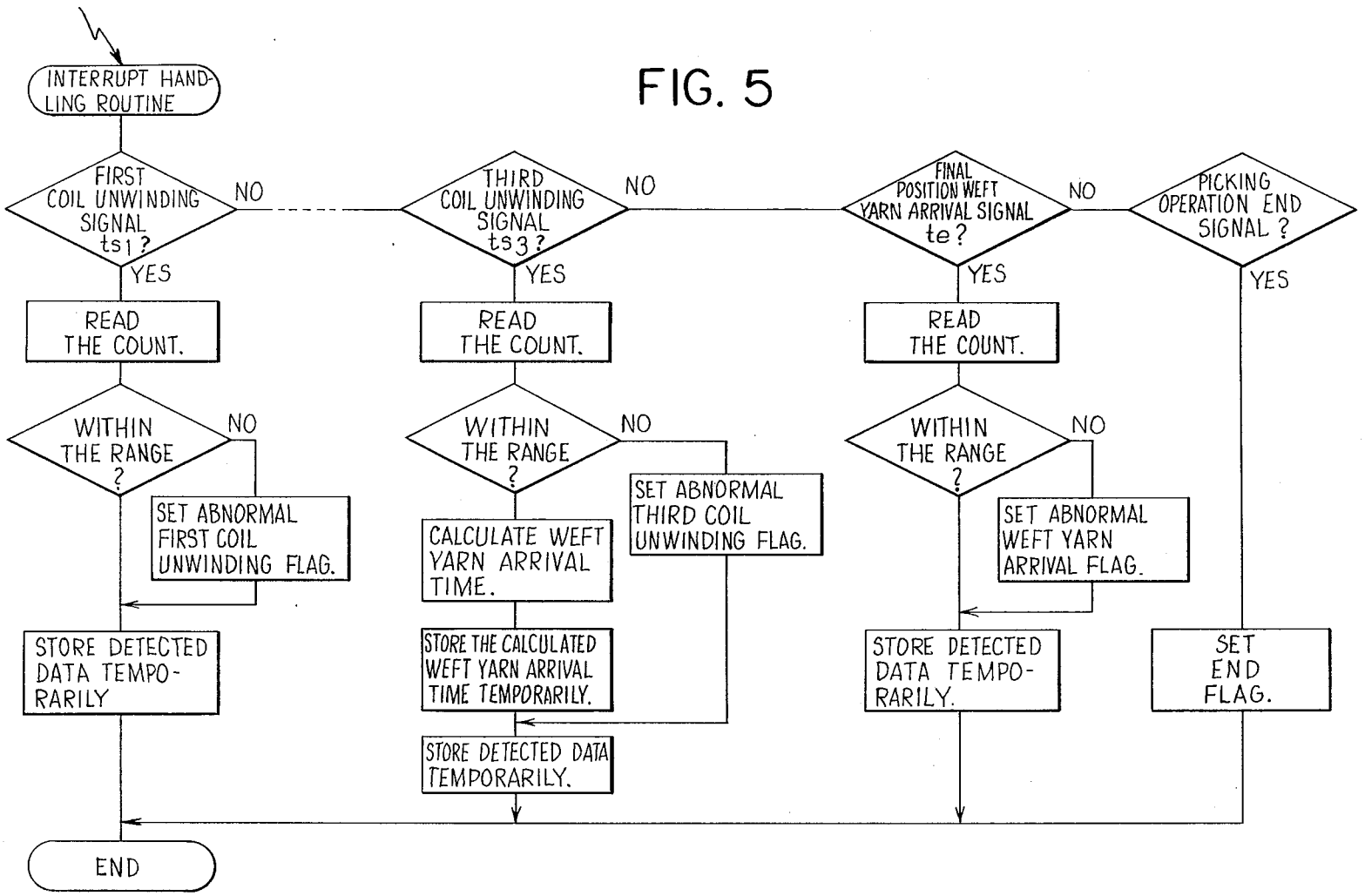
FIG. 5 is a flow chart of an interrupt handling routine, namely, a diagnosing program.

On the other hand, the CPU 31 of the arithmetic and logic unit 30 reads a predetermined program shown in FIG. 5 from the ROM 32 and starts the same. This program is an interruption handling routine to the main routine shown in FIG. 6.

Upon the reception of the output signal of the restraining pin retraction signal generator 43, the mode of the counter 40 changes to an enable mode and starts counting clock pulses provided by the clock pulse generator 41 at the moment of retraction of the restraining pin 6.

The CPU 31 receives a signal representing the actual unwind time $t_{s1}$ from the unwind detector 14, and then makes a decision as to whether or not the signal indicates the unwinding of the first coil of the weft yarn. When the decision is YES, the CPU 31 reads the count of the counter 40 and makes a decisin as to whether or not the count is within the allowable range $\Delta t_1$. When the actual unwind time $t_s$ is beyond the allowable time range $\Delta t_1$, the CPU 31 sets a flag indicating abnormal unwinding of the first coil of the weft yarn 2. The CPU 31 stores the actual unwind time $t_s$ temporarily in the RAM 33. Thus, a routine necessary for monitoring the unwinding of the first coil of the weft yarn 2 is ended. The same routine is executed also for monitoring the unwinding of the second coil of the weft yarn 2.

When an unwind signal indicating the unwinding of the third coil of the weft yarn 2 is provided, substantially the same routine is executed, except that the routine for the unwinding of the third coil of the weft yarn 2 includes a step of calculating the target weft yarn arrival time $T_e$, in which an operation: $T_e = t_{s3} + \Delta t_s$ is carried out. The target weft yarn arrival time $T_e$ thus obtained is stored temporarily as an estimated value and serves as a target value for the following picking operation.

Upon the reception of the output signal of the final position weft yarn arrival detector 15, the CPU 31 executes the same routine as those for the first and second coils of the weft yarn 2. Upon the reception of a picking end time signal from the picking end time detector 42, the CPU 31 sets an end flag to end the interruption handling routine, and the mode of the counter 40 is changed to a reset mode. During a series of the processes, the CPU 31 reads the counts of the counter 40 at the moment of reception of the output signals of the weft yarn arrival detectors 15, 16 and 17, respectively. Signals provided by the pressure sensors 25 and 29, and the yarn change detector 44 at predetermined crankshaft angles, respectively, are stored in the RAM 33. The data stored in the RAM 33 are read by the CPU 31, when an abnormal picking operation occurs, to specify the cause of the abnormal picking operation.

Figure 6:
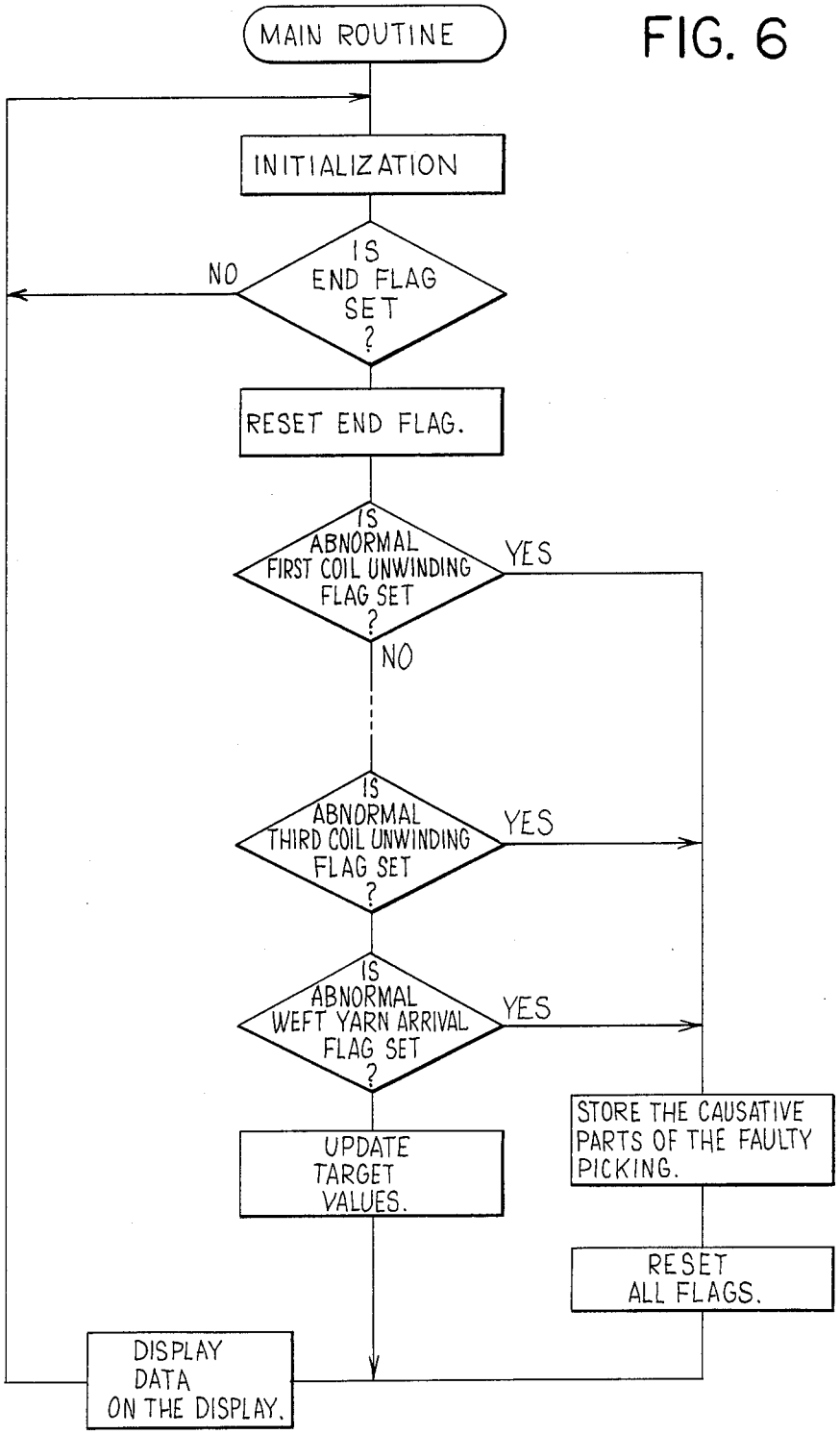
FIG. 6 is a flow chart of a main routine.

Referring to FIG. 6 showing the main routine, first, the system is initialized, and then a decision is made as to whether or not the interruption handling routine end flag is set. When the decision is YES, namely, after confirming the end of the interruption handling routine, then the end flag is reset, and then the foregoing subroutine is executed to decide whether or not an abnormality flag is set. When the decision is NO, the values stored temporarily, such as those measured previously and the target weft yarn arrival time $T_e$ determined in the preceding control operation, are written as reference values and are diplayed on the display unit 37 as monitoring data.

When abnormality flags are set for the unwinding times $t_{s1}$, $t_{s2}$ and $t_{s3}$ or an abnormality flag is set for the final position weft yarn arrival time $t_e$, the contents are stored together with the causative parts of the abnormalities, and then all the abnormality flags are reset. Such a state is displayed, similarly to the foregoing data, on the display 37 together with the corresponding parts by suitable means such as colored classification marks.

The reference values are updated every one rotation of the crankshaft 38, namely, every one weaving cycle of the loom. However, if necessary, each reference value may be the average of normal values measured in several weaving cycles. furthermore, continuously measuring the pressures of the picking fluid at the main picking nozzle 7 and the auxiliary nozzles 11, 12 and 13, and the jet starting crankshaft angles of the same, and displaying the results of comparison of the measurements and the corresponding reference values will facilitate finding the causative parts of a faulty picking operation when the loom is stopped due to the faulty picking operation.

Figure 7:
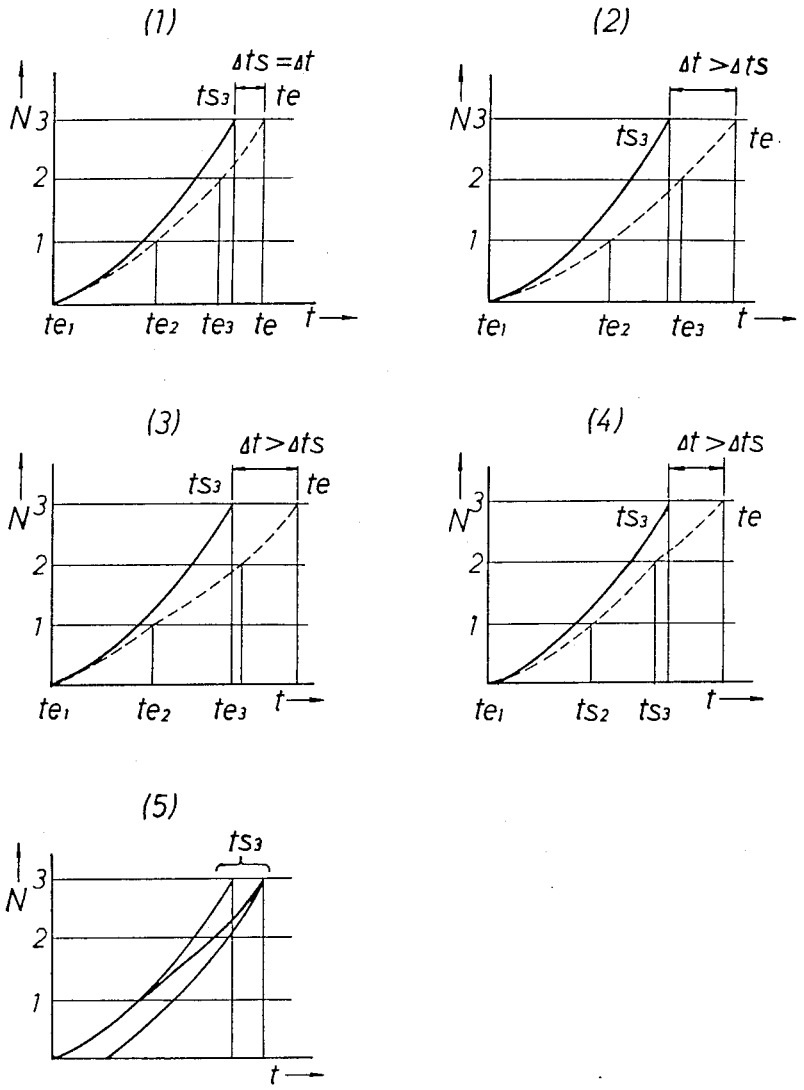
FIGS. 7-(1), 7-(2), 7-(3), 7-(4) and 7-(5) are graphs showing modes of travel of the weft yarn in various modes of faulty picking operation.

FIG. 7-(1) to 7-(5) are graphs showing the relation between the number of unwound coils of the weft yarn 2 (the distance of travel of the weft yarn 2) and time t, in which curves indicated by continuous lines, respectively, represent, similarly to that in FIG. 4, modes of unwinding the coils of the weft yarn 2, while curves indicated by broken lines, respectively, represent modes of travel of the picked weft yarn 2, respectively.

FIG. 7-(1) shows a correct picking operation, in whch the coils of the weft yarn 2 are unwound normally and the picked weft yarn 2 travels normally. The curves are quadratic.

FIG. 7-(2) shows a faulty picking operation, in which the coils of the weft yarn 2 are unwound normally, whereas the travel of the picked weft yarn 2 is delayed, and hence the actual time difference $\Delta t$ is considerably greater than the reference time difference $t_s$. Such a faulty picking operation is considered to be due to the insufficient pressure of the picking fluid supplied to the auxiliary nozzles 11, 12 and 13 and/or the inappropriate diposition of the auxiliary nozzles 11, 12 and 13.

FIG. 7-(3) shows a faulty picking operation, in which the auxiliary nozzles 12 of the second group are considered to be defective. The coils of the weft yarn 2 are unwound normally, nevertheless, the travel of the picked weft yarn 2 is delayed after the picked weft yarn 2 has entered the region of the auxiliary nozzles 12 of the second group. Accordingly, such a faulty picking operation is considered to be due to an insufficient pressure of the picking fluid supplied to the auxiliary nozzles 12, the inapopropriate disposition of the auxiliary nozzles 12 and /or the soiling of the guides 9 of the reed 8 in a portion thereof corresponding to the region of the auxiliary nozzles 12.

FIG. 7-(4) shows a faulty picking operation, in which the auxiliary nozzles 13 of the third group and/or the corresponding portion of the guides 9 of the read 8 is considered to be defective similarly to the case of FIG. 7-(3).

FIG. 7-(5) shows a faulty picking operation, in which the coils of the weft yarn 2 are not unwound normally. When the actual curve deviates from the reference curve from the midway thereof, it is considered that the second coil of the weft yarn 2 is not unwound normally. When the actual curve is deviated from the reference curve from the start of the same, it is considered that the first coil of the weft yarn 2 is not unwound normally.

Thus, it is possible to determine whether the picking operation is correct or faulty by measuring the actual unwind times $t_{s1}$ $t_{s2}$ and $t_{s3}$, the actual time difference $\Delta t$, and the actual weft yarn arrival time $t_e$. It is also possible at least to determine whether the causative agency of the faulty picking operation is in the weft yarn unwinding operation or in the path 10.

When something is wrong with the path 10, a defective part in the path 10 can easily be located from the actual weft yarn arrival times $t_{e1}$, $t_{e2}$, $t_{e3}$ and $t_e$ detected by the weft yarn arrival detectors 16, 17, 18 and 15, respectively. The actual weft yarn arrival times $t_{e1}$, $t_{e2}$, $t_{e3}$ and $t_e$ detected respectively by the weft yarn arrival detectors 16 , 17, 18 and 15 are stored sequentially through the CPU 31 in the RMA 33. Upon the occurence of a faulty picking operation, the stored data is read from the RAM 33 and are displayed on the display unit 37 in a graph as shown in FIGS. 7-(1) to 7-(5) to enable the immediate location of the defective part.

In the embodiment described herein, the unwind time and the weft yarn arrival time detected by the unwinding detector 14 and the final position weft yarn arrival detector 15, respectively, are compared with the corresponding target values. However, the comparison of the weft yarn arrival times detected by the weft yarn arrival detectors 16, 17 and 18 with the corresponding target values will enable further accurate location of defective parts.

The pressure sensors 25 and 29 and the yarn change detector 44 are effective means to provide clues to finding the causes of the faulty picking operation. The CPU 31 reads values measured by the pressure sensors 25 and 29 and the yarn change detector 44 to prepare for the determination of the causes of the faulty picking operation.

Although the invention has been described in its preferred form with a certain degree of particularity, it is to be understood that many variaitos and changes are possible in the invention without departing from the scope thereof.

What is claimed is:

1. A faulty picking diagnosing system for a fluid jet loom which measures and stores a weft yarn (2) by winding the weft yarn (2) around a stationary drum (5) through the rotary motion of a rotary yarn guide (4), releases the weft yarn (2) wound on the drum (5) by retracting a restraining pin (6), and jets a picking fluid with a main picking nozzle (7) and auxiliary nozzles (11, 12, 13) to pick the weft yarn (2), which comprises:

an unwinding detector (14) disposed adjacent to a weft yarn unwinding position to detect a time when each of the coils of the weft yarn (2) is unwound;

weft yarn arrival detectors (15, 16, 17, 18) distributed in the path (10) of travel of the picked weft yarn (2) to detect the time of arrival of the free end of the picked weft yarn (2) at the corresponding positions; and an arithmetic and logic unit (30) which determines the causes of a faulty picking operation from the difference between actual unwind time when the coils of the weft yarn (2) are unwound actually and the corresponding target values, and the difference between actual weft yarn arrival times and the corresponding target weft yarn arrival times.

2. A faulty picking diagnosing system according to claim 1, wherein at least one (15) of the weft yarn arrival detectors (15, 16, 17, 18) is disposed at a position corresponding to the final arrival position of the free end of the picked weft yarn (2).

3. A faulty picking diagnosing system according to claim 1, wherein one (15) of the weft yarn arrival detectors (15, 16, 17, 18) is disposed at a position corresponding to the final arrival position of the free end of the picked weft yarn (2), while the rest of the weft yarn arrival detectors are distributed at predtermined intervals in the path (10) of the picked weft yarn (2).

4. A faulty picking diagnosing system according to claim 1, wherein said arithmetic and logic unit (30) comprises: an input port (34) connected to the weft yarn arrival detectors (15, 16, 17, 18) and a counter circuit (45) for measuring time; an output port (35) connected to shutoff valves (21, 22, 23, 26) respectively for controlling the supply of a picking fluid to the auxiliary nozzles (11, 12, 13) and the main picking nozzle (7), and a display unit (37); a ROM (32) storing a picking operation control program and a faulty picking diagnosing program; a RAM (33) for storing measured data; and a CPU (31) which transfers data between the RAM (33), the input port (34) and the output port (35), and executes operations for comparing the data stored in the RAM (33).

5. A faulty picking diagnosing system according to claim 4, wherein said counting circuit (45) comprises: a clock pulse generator (41) which generates clock pulses; and a counter (40) which starts counting the clock pulses generated by the clock pulse generator (41) at a moment when the restraining pin (6) is retracted to release the weft yarn (2) wound on the drum (5), and ends counting the clock pulses generated by the clock pulse generator (41) at the end of a picking cycle.

* * * * *